US006170467B1

(12) United States Patent
Girard

(10) Patent No.: US 6,170,467 B1
(45) Date of Patent: Jan. 9, 2001

(54) DEVICE FOR FIXING A FUEL INJECTOR ON AN INTERNAL COMBUSTION ENGINE CYLINDER HEAD, AND METHOD FOR FIXING SAID INJECTOR

(75) Inventor: Didier Girard, Menucourt (FR)

(73) Assignees: Automobiles Peugeot, Paris; Automobiles Citroën, Neuilly sur Seine, both of (FR)

( * ) Notice: Under 35 U.S.C. 154(b), the term of this patent shall be extended for 0 days.

(21) Appl. No.: 09/214,235

(22) PCT Filed: Apr. 30, 1998

(86) PCT No.: PCT/FR98/00874

§ 371 Date: Mar. 31, 1999

§ 102(e) Date: Mar. 31, 1999

(87) PCT Pub. No.: WO98/53197

PCT Pub. Date: Nov. 26, 1998

(30) Foreign Application Priority Data

May 20, 1997 (FR) ..... 97 06112

(51) Int. Cl.[7] ..... F02M 55/02
(52) U.S. Cl. ..... 123/470
(58) Field of Search ..... 123/470, 472

(56) References Cited

U.S. PATENT DOCUMENTS 5,566,658 * 10/1996 Edwards et al. ..... 123/470
5,697,345 * 12/1997 Genter et al. ..... 123/470
5,878,719 * 3/1999 Nakagomi ..... 123/470
5,899,190 * 10/1996 Nakagomi et al. ..... 123/470

* cited by examiner

*Primary Examiner*—Thomas N. Moulis
(74) *Attorney, Agent, or Firm*—Pollock, Vande Sande & Amernick, R.L.L.P.

(57) ABSTRACT

A device for fixing a fuel injector (12) in an internal combustion engine cylinder head (1) whereon is set a camshaft bracket (4) top surface delimiting with this surface a chamber (8) containing valve-actuating mechanical members. The injector (12) passes through the camshaft bracket (4) and the cylinder head (1) supported on the base (18) of a recess (14) in the cylinder head by a fork (20) fixed by a screw (26) to the cylinder head (1). The fork (20) is arranged in the chamber (8) under a camshaft (6) extending perpendicular to said shaft (6) and comprises two branches (20*a*, 20*b*) which are supported on either side of the injector body (12), in useful fixing position, on two wings (21, 22) symmetrically arranged on the injector (12) body periphery.

6 Claims, 2 Drawing Sheets

DEVICE FOR FIXING A FUEL INJECTOR ON AN INTERNAL COMBUSTION ENGINE CYLINDER HEAD, AND METHOD FOR FIXING SAID INJECTOR

FIELD OF THE INVENTION

This invention relates to a device for fixing a fuel injector on an internal combustion engine cylinder head and a method for fixing said injector.

More specifically, the invention relates to a device for fixing an injector that passes through the cylinder head and exits the latter on a lower side covering a supposedly vertical master cylinder and protruding from the cylinder head on an accessible upper side.

BACKGROUND OF THE INVENTION

Known in the prior art are devices for fixing such injectors where the injector is held in place on the bottom of a casing, called shaft, in a lower side of the cylinder head, by a sliding collar attached by screws to an upper part of the cylinder head. This collar surrounds the body of the injector and rests on the protruding part of a snap ring mounted in a peripheral groove of the body of the injector.

The major drawback of such devices resides in the fact that the area where the body injector is held in place by the collar is relatively far from the support side of the injector on the bottom. This can cause the body of the injector to buckle, which negatively affects its reliability. Furthermore, since the collar is fixed on the accessible upper side of the cylinder head, such a device causes an upward congestion of the main injector.

Also know is a device that makes it possible to extenuate the afore-mentioned inconveniences, as described in particular in DE 43 15 233, in which the means of fixation are integrated in the cylinder head, in a chamber that contains the mechanical components that activate the valves and consist of a cylinder liner that surrounds the injector body and assures support on the snap ring located on the injector relatively close to the bottom of the shaft. This liner is attached to the cylinder head by a yoke that rests on two external transversal liner wings under the tightening action of a screw in the cylinder head.

Such a device requires relatively complex and costly means of tight shutoff and requires that the injector be dismantled which is quite difficult, in particular when the cylinder head is equipped with a camshaft that passes through its upper part.

The object of this invention is to propose a device similar to the one described above and that remedies the above-mentioned inconveniences.

With this end in view, the object of this invention is a device for fixing a fuel injector on the cylinder head of an internal combustion engine, on the upper face of which rests a camshaft holder that delimits with this face a chamber that contains mechanical components that activate the valves, where the injector passes through the camshaft holder and the cylinder head, and is held in place on the bottom of a shaft of the cylinder head by a yoke that is attached by a screw to the cylinder head, characterized by the fact that the yoke is located in the chamber under a camshaft and extends perpendicularly to this shaft.

According to a few interesting provisions of the invention:

- the yoke consists of two branches that, in the operating position, rest on either side of the injector body on two wings arranged symmetrically on the periphery of the injector body;
- the branches demarcate between them a space that only lets the wings of the injector pass through when the latter is turned approximately a quarter turn in relation to its operating position;
- the injector body consists of a wide cylindrical section tightly held in a bore of the camshaft holder, with a diameter large enough to let the wings pass through;
- the camshaft holder consists, on the right of the retainer screw of the yoke, of a conduit that is large enough so a tightening tool for said screw can pass through;
- the shaft is made of a tube that is tightly attached to the cylinder head while passing through a chamber made in the cylinder head that contains a cooling liquid;

Another object of this invention relates to a method for mounting a device for fixing a fuel injector consistent with the device described above, characterized by the fact that:

- the yoke and its screw are put in place, without tightening the screw, then the camshaft holder is is put on the cylinder head that has been previously equipped with valves and mechanical components for their activation,
- the injector body is inserted in an appropriate bore of the camshaft holder by setting the median axis of the wings of this body parallel to the branches of the yoke, until this injector rests on the bottom of the shaft; the wings will then be under the yoke,
- by means of the head of the injector, we perform a rotation of approximately one quarter turn of the latter in order to position the median axis of the wings perpendicularly to the branches,
- and the injector is fixed in the operating position obtained by tightening the retainer screw of the yoke.

The above-mentioned characteristics of the invention, as well as others, will appear more clearly when reading the following description of a concrete example while referring to the attached drawings in which.

Figure 1:
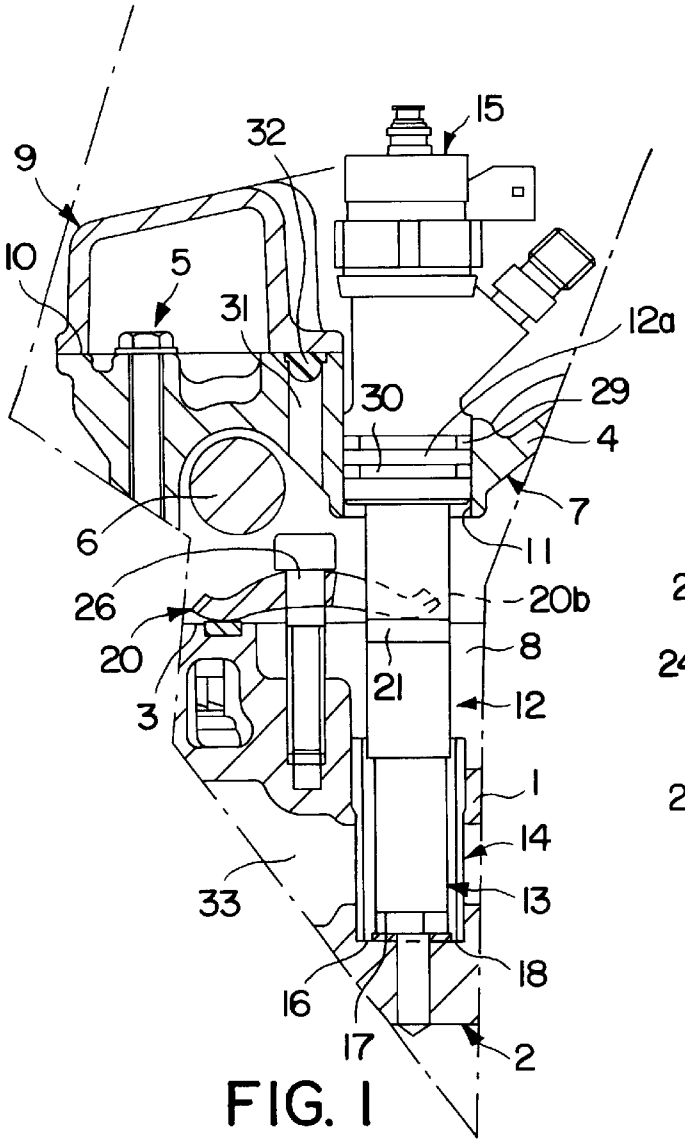
FIG. 1 is a sectional view through a vertical plane of a cylinder head of an internal combustion engine equipped with an injector that is attached by a device consistent with the invention.

FIG. 1 represents the upper part of a diesel engine with direct injection, consisting of a cylinder head 1 containing on the one hand a horizontal lower face 2, considering the figure, adapted for covering a cylinder block of the engine and on the other hand, an upper face 3 on which rests a camshaft holder 4 attached to the cylinder head 1 by means of retainer screws 5.

The camshaft holder 4 serves as a bearing for at least one camshaft 6 located above the upper face 3 of the cylinder head and in a hole 7 of the camshaft holder 4 which constitutes a part of a chamber 8 delimited between the latter and the cylinder head, and containing mechanical components for the control of conventional valves. A lid 9—or cylinder head cover—is arranged on an upper face 10 of the camshaft holder.

The camshaft holder 4 is equipped with a bore 11 large enough to let a fuel injector body 12 in the general shape of a cylinder through, following a vertical axis.

The injector body 12 is equipped on the one hand with a lower portion 13 located in an opening 14 called well made in the cylinder head 1, and on the other hand with an upper portion 15 that forms the head of the injector that protrudes from the cover so as to make it accessible.

This injector body 12 has in its lower part 13 a radial shoulder that conventionally rests, with the interposition of a copper sealing washer 17, against the bottom 18 of the well.

According to this invention, the injector 12 is attached to the cylinder head 1 by a yoke 20 with two branches 20*a*, 20*b* that rest on either side of the injector body 12 on two radial wings 21, 22 arranged symmetrically on the periphery of the injector body 12 and extend, in operating position, perpendicularly to the branches.

The space delimited by the branches 20*a*, 20*b* is sufficiently large for the wings 21, 22, placed parallel to the branches, to pass through at the time of assembly The wings 21, 22 are sensibly arranged on the injector body 12 at equal distance from its extremities 15, 13 which makes it possible to reduce the buckling of the body when it is compressed axially by the tightening of the yoke.

Figure 2:
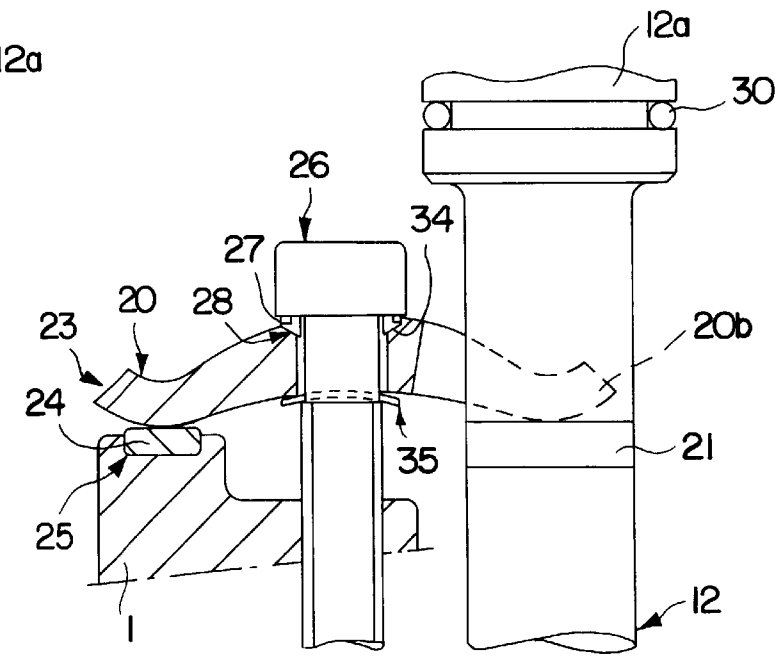
FIG. 2 is a sectional view on a larger scale of the device for fixing the injector consistent with the invention.

The yoke 20 rests at its extremity 23 opposite to the branches, as can be seen in FIG. 2, on a segment 24 that resides, by binding, in a counter-bore 25 made in the upper face 3 of the cylinder head thus avoiding the dulling of the latter during the tightening of the device.

A retainer screw 26 passes through the center of this yoke 20 allowing for the application of the branches of the yoke on the wings 21, 22 and the fixation of the injector body 12 on the cylinder head 1.

A spherical washer 27 is inserted between the head of the screw 26 and the yoke 20. This washer has a conical side 28 that cooperates with a conical bore 34 made on the yoke in order to assure a good coaxiality between the screw 26 and the hole of the yoke, as can be seen in FIG. 2.

A washer 35 called "unlosable washer" is fixed to the screw 26 at the level of the bottom of the thread of the latter thus making one of the screw-yoke set.

The injector body 12 has, between its head 15 and the wings 21, 22, a wide cylindrical segment 12*a* sealed, thanks to O-rings 29, 30, in the bore 11 of the camshaft holder. The diameter D of this bore and of segment 12*a* is greater than the measurement between the extremities of the wings in order to leave room for the wings to fit through during the mounting of the injector.

The fixing of the injector onto the cylinder head 1 using the yoke 20 is performed as follows: the yoke 20 and its screw 26 as well as the camshaft holder 4 and the mechanical components that command the valves are previously assembled on the cylinder head.

Figures 3, 4, 5:
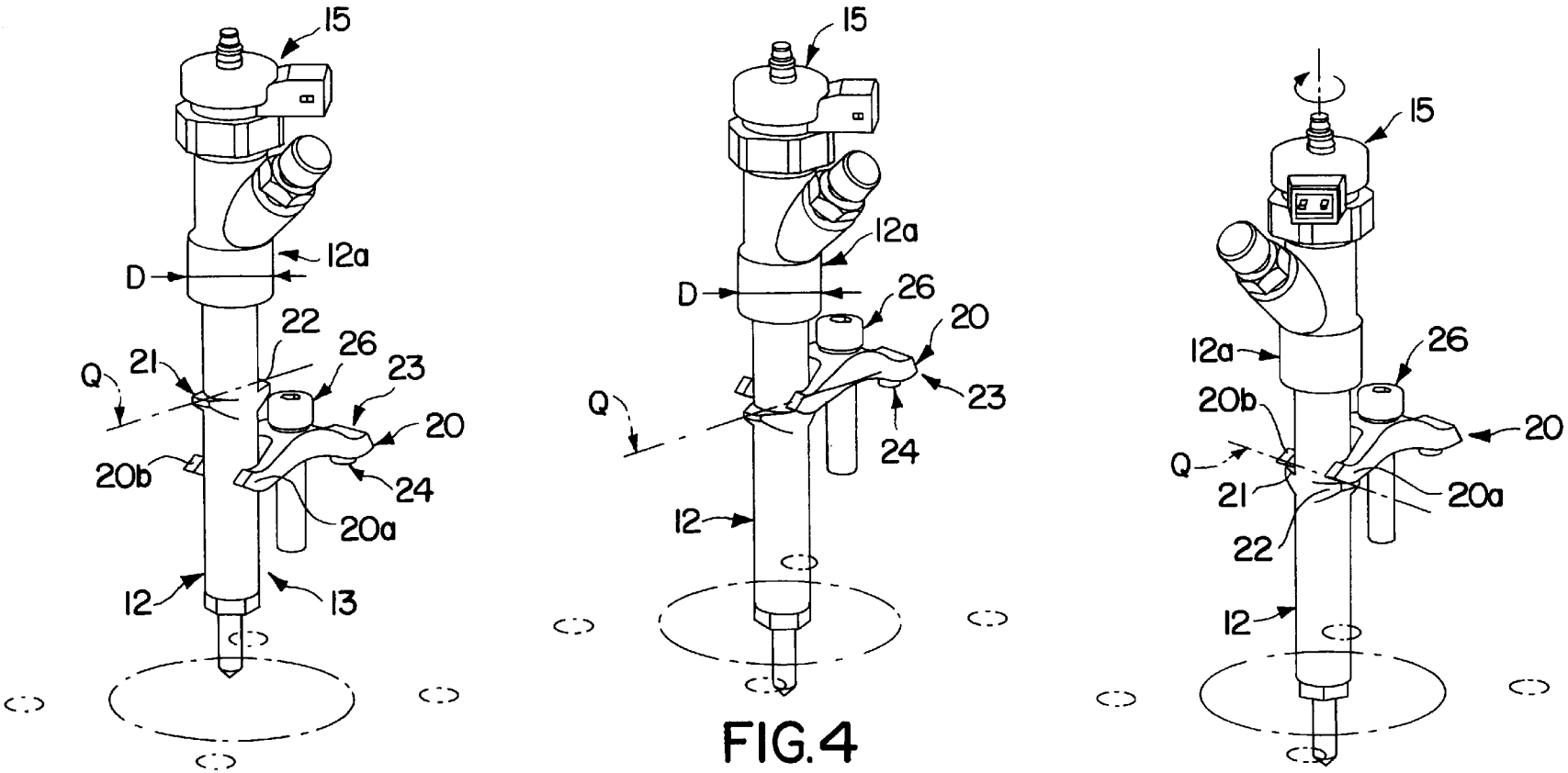
FIGS. 3 through 5 are perspective views of an injector and the device for fixing it, showing the various steps used in mounting the injector.

During a first step, the operator engages the injector body 12 in the bore 11 of the camshaft holder 4, arranging the median axis Q of the wings 21,22 parallel to the branches, as can be seen in FIGS. 3 and 4, until the injector is resting on the bottom 18 of the shaft 14; the wings 21, 22 will then be under the yoke.

The operator then performs a rotation of approximately one quarter turn by means of the head of the injector 15, as can be seen in FIG. 5, to the body 12 of the injector so that the median axis Q of the wings 21,22 is perpendicular to the branches 20*a*, 20*b*.

Lastly, the tightening of the retainer screw 26 that insures the injector is held in place in the operating position on the bottom 18 of the shaft 14, is performed using a tool that passes through a vertical conduit 31 made in the camshaft holder 4 to the right of the retainer screw 26.

This conduit 31 is later plugged with a stopper 32 or any other similar means, insuring that it is tightly sealed. During a final step, the operator covers the camshaft holder 4 with the lid 5.

In an advantageous provision, the shaft 14 of the injector is made of a tube attached to the cylinder head, for example by binding, while it passes through a chamber 33 of cooling liquid, made in the cylinder head 1, insuring in this way a good thermal exchange with this liquid in the lower part 13 of the injector body 12.

Such a device, consistent with the invention, has the advantage of producing a reduced crowding in the chamber, as can be seen in FIG. 2, in particular thanks to the placement of the yoke 20 that resides under a camshaft and perpendicular to the latter, and of insuring a stable hold of the injector with a maximum reduction of the buckling that can negatively affect the reliability of the injector Furthermore, this arrangement, while being simple to perform and not very costly, allows for a very easy mounting and dismantling of the injector that only require the handling of a limited number of parts that make up the injector environment.

What is claimed is:

1. A device for fixing a fuel injector in a cylinder head (1) of an internal combustion engine on which rests, on an upper face, a camshaft holder (4) that demarcates with said upper face a chamber (8) containing mechanical components that activate valves, wherein the injector passes through the camshaft holder (4) and the cylinder head (1) and is held in place on the bottom (18) of the shaft (14) of the cylinder head (1) by a yoke (20) attached by a screw (26) to the cylinder head, and wherein the yoke (20) consists of two branches (20*a*, 20*b*) which rest, in fixed operating position, on either side of a body of the injector (12) on two wings (21,22) arranged symmetrically on a periphery of the injector body, so that the yoke (20) is set in the chamber (8) under a camshaft (6) and extends perpendicularly to said camshaft.

2. The device for fixing according to claim 1, wherein the branches (20*a*, 20*b*) demarcate between them a space sufficient to allow passage of said wings (21, 22) only when the latter is turned approximately one-quarter turn in relation to its operating position.

3. The device for fixing according to claim 1, wherein the injector body (12) consists of a wide cylindrical section (12*a*) sealed in a bore (11) of said camshaft holder (4), with a diameter (D) that is large enough to allow passage of said wings (21, 22).

4. The device for fixing according to claim 1, wherein the camshaft holder (4) has, to the right of the retainer screw (26) of the yoke (20), a conduit (31) that allows passage of a tightening tool for said screw.

5. The device for fixing according to claim 1, wherein the shaft (14) is made of a tube attached to the cylinder head (1) that passes through the chamber (33) that contains a cooling liquid.

6. A method for mounting a device for fixing a fuel injector as claimed in claim 1, said method including the steps of (a) positioning the yoke (20) and screw (26), without tightening the screw;

(b) setting the camshaft holder on the cylinder head;

(c) engaging the injector body in a bore (11) of the camshaft holder by positioning a median axis (Q) of the wings (21, 22) parallel to the branches (20*a*, 20*b*) until the injector rests on the bottom (18) of the shaft, with the wings under the yoke;

(d) rotating the injector approximately one-quarter turn by means of the head (15) of the injector so as to position the median axis (Q) of the wings (21, 22) perpendicularly to the branches (20*a*, 20*b*); and (e) tightening the retainer screw of the yoke to fix the injector in operating position.

* * * * *